US009221647B2

(12) United States Patent
Furuhashi et al.

(10) Patent No.: US 9,221,647 B2
(45) Date of Patent: Dec. 29, 2015

(54) SHEET FOLDING APPARATUS, IMAGE FORMING APPARATUS, AND IMAGE FORMING SYSTEM

(71) Applicants: Tomohiro Furuhashi, Kanagawa (JP); Shuuya Nagasako, Kanagawa (JP); Michitaka Suzuki, Kanagawa (JP); Kazuya Yamamoto, Kanagawa (JP); Kyosuke Nakada, Kanagawa (JP); Akira Kunieda, Tokyo (JP); Takahiro Watanabe, Kanagawa (JP); Yuji Suzuki, Kanagawa (JP); Kiichiro Goto, Kanagawa (JP)

(72) Inventors: Tomohiro Furuhashi, Kanagawa (JP); Shuuya Nagasako, Kanagawa (JP); Michitaka Suzuki, Kanagawa (JP); Kazuya Yamamoto, Kanagawa (JP); Kyosuke Nakada, Kanagawa (JP); Akira Kunieda, Tokyo (JP); Takahiro Watanabe, Kanagawa (JP); Yuji Suzuki, Kanagawa (JP); Kiichiro Goto, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/091,692

(22) Filed: Nov. 27, 2013

(65) Prior Publication Data

US 2014/0171283 A1 Jun. 19, 2014

(30) Foreign Application Priority Data

Dec. 14, 2012 (JP) ..... 2012-273231

(51) Int. Cl.
*B65H 45/20* (2006.01)
*B65H 45/04* (2006.01)
(Continued)

(52) U.S. Cl.
CPC *B65H 45/04* (2013.01); *B31F 1/10* (2013.01); *B65H 45/14* (2013.01); *B65H 45/147* (2013.01);
(Continued)

(58) Field of Classification Search
CPC ..... B31F 1/10; B31F 1/0025; B65H 45/20; B65H 45/147
USPC ..... 270/32, 39.01; 493/416, 419, 434, 435, 493/421, 440, 442
See application file for complete search history.

(56) References Cited

U.S. PATENT DOCUMENTS 3,729,186 A * 4/1973 Macke ..... 493/360
5,067,305 A 11/1991 Baker et al.
(Continued)

FOREIGN PATENT DOCUMENTS

EP 0447179 A2 9/1991
EP 0469867 A2 2/1992
(Continued)

OTHER PUBLICATIONS

Extended European Search Report dated Mar. 25, 2014 issued in corresponding European Application No. 13194286.4.
(Continued)

*Primary Examiner* — Leslie A Nicholson, III
(74) *Attorney, Agent, or Firm* — Harness, Dickey & Pierce, P.L.C.

(57) ABSTRACT

A sheet folding apparatus includes: a folded part forming unit that forms a folded part on the sheet by nipping a curved portion formed on a part of the sheet between an upstream first sheet conveying unit and a downstream second sheet conveying unit by holding a part of the sheet by the first sheet conveying unit and applying conveying force to the sheet to reverse the sheet upstream by the second sheet conveying unit; and a sheet leading end detection unit disposed downstream of or at almost same position as the second sheet conveying unit. The sheet is conveyed based on a detection timing of the sheet leading end detection unit such that the leading end of the sheet protrudes by a predetermined protrusion amount from the second sheet conveying unit immediately before applying conveying force to the sheet to reverse the sheet.

12 Claims, 12 Drawing Sheets

(51) Int. Cl.

| | |
|---|---|
| ***B31F 1/10*** | (2006.01) |
| ***B65H 45/14*** | (2006.01) |
| *B31F 1/00* | (2006.01) |

(52) U.S. Cl.

CPC ..... *B65H 45/20* (2013.01); *B31F 1/0025* (2013.01); *B65H 2801/03* (2013.01); *B65H 2801/27* (2013.01)

(56) References Cited

U.S. PATENT DOCUMENTS

| | | | | |
|---|---|---|---|---|
| 5,233,400 | A | 8/1993 | Cahill | |
| 5,344,379 | A | 9/1994 | Garrone | |
| 6,719,680 | B2 * | 4/2004 | Hosoya et al. | 493/324 |
| 6,730,010 | B2 * | 5/2004 | Yamakawa et al. | 493/267 |
| 7,052,005 | B2 * | 5/2006 | Yamakawa et al. | 270/37 |
| 7,658,372 | B2 * | 2/2010 | Kubo | 270/37 |
| 7,946,565 | B2 * | 5/2011 | Kubota et al. | 270/39.01 |
| 8,226,077 | B2 * | 7/2012 | Iguchi et al. | 270/37 |
| 2003/0040415 | A1 | 2/2003 | Yamakawa et al. | |
| 2007/0176357 | A1 | 8/2007 | Horio et al. | |
| 2007/0238596 | A1 | 10/2007 | Terhaag et al. | |
| 2008/0001338 | A1 | 1/2008 | Kotani | |
| 2009/0062100 | A1 | 3/2009 | Takekawa et al. | |
| 2009/0129840 | A1 | 5/2009 | Takekawa et al. | |
| 2010/0252981 | A1 | 10/2010 | Kimata et al. | |
| 2011/0190109 | A1 | 8/2011 | Kimata | |
| 2011/0221125 | A1 | 9/2011 | Kimata | |

FOREIGN PATENT DOCUMENTS

| | | |
|---|---|---|
| EP | 0590359 A1 | 4/1994 |
| JP | 2006-117383 | 5/2006 |
| JP | 2007-277006 | 10/2007 |

OTHER PUBLICATIONS

Chinese Office Action and English translation thereof dated Sep. 1, 2015.

* cited by examiner

SHEET FOLDING APPARATUS, IMAGE FORMING APPARATUS, AND IMAGE FORMING SYSTEM

CROSS-REFERENCE TO RELATED APPLICATIONS

The present application claims priority to and incorporates by reference the entire contents of Japanese Patent Application No. 2012-273231 filed in Japan on Dec. 14, 2012.

BACKGROUND OF THE INVENTION

1. Field of the Invention

The present invention relates to a sheet folding apparatus that performs folding processing on a sheet, an image forming apparatus equipped with the sheet folding apparatus, and an image forming system.

2. Description of the Related Art

A conventional sheet folding apparatus is known that performs folding processing in which a curved portion (bend) formed on a sheet is nipped and conveyed between a pair of folding rollers that is a pair of roller members to form a folded part.

A sheet folding apparatus described in Japanese Laid-open Patent Publication No. 2007-277006 includes a pair of upstream conveying rollers and a pair of downstream conveying rollers that are disposed along a sheet conveying direction and that hold a part of a sheet to apply conveying force to the sheet. The sheet folding apparatus also includes a pair of folding rollers that forms a folded part on the sheet by nipping a curved portion formed by bending the sheet between the pair of upstream conveying rollers and the pair of downstream conveying rollers. The following describes how the sheet folding processing is performed. The pair of upstream conveying rollers and the pair of downstream conveying rollers each hold a part of the sheet, and the pair of downstream conveying rollers applies conveying force to the sheet to reverse the sheet upstream in the sheet conveying direction, thereby forming a curved portion on the sheet between the pair of upstream rollers and the pair of downstream rollers. The curved portion thus formed is then guided to and nipped between the pair of folding rollers to form a folded part on the sheet.

It is desirable that a sheet folding apparatus can perform various types of folding processing such as twofold processing, z-shaped folding processing, outer-threefold processing, and inner-threefold processing. Such various types of folding processing can be performed by changing the position of a folded part on a sheet in a sheet conveying direction depending on the types of the folding processing. The position of the sheet folded part in the sheet conveying direction can be changed by changing a protrusion amount of the leading end of the sheet from the pair of downstream conveying rollers when the sheet is stopped depending on the types of the folding processing.

It is conceivable that the sheet folding apparatus includes a sheet leading end detection sensor for stopping the sheet with the leading end of the sheet protruding from the pair of downstream conveying rollers by a predetermined protrusion amount by controlling the pair of upstream conveying rollers and the pair of downstream conveying rollers on the basis of a detection timing of the leading end of the sheet detected by the sensor. For example, the sheet leading end detection sensor is disposed upstream of the pair of upstream conveying rollers in the sheet conveying direction, and after a predetermined time has passed since the sheet leading end detection sensor detected the leading end of the sheet, the sheet folding apparatus stops the pair of upstream conveying rollers and the pair of downstream conveying rollers to stop conveying the sheet.

The sheet is held only by the pair of upstream conveying rollers during travelling from the pair of upstream conveying rollers toward the pair of downstream conveying rollers. Because of this, the behavior of the sheet between the pairs of upstream and downstream conveying rollers varies depending on, for example, stiffness or curling of the sheet. When the behavior of the sheet between the pairs of upstream and downstream conveying rollers varies, the sheet takes different courses in a sheet conveying path from the pair of upstream conveying rollers to the pair of downstream conveying rollers, thereby changing a timing at which the leading end of the sheet reaches the pair of downstream conveying rollers. Thus, when the sheet folding apparatus stops conveying the sheet after a predetermined time has passed since the sheet leading end detection sensor detected the leading end of the sheet, the protrusion amount varies. Consequently, the sheet folding apparatus cannot stop the sheet at an exact position, thus, positions of the sheet folded part varies in the sheet conveying direction, thereby being unable to perform good folding processing.

In view of the above, there is a need to provide a sheet folding apparatus that can reduce variations of the position of a folded part formed on a sheet in a sheet conveying direction, and an image forming apparatus and an image forming system equipped with the sheet folding apparatus.

SUMMARY OF THE INVENTION

It is an object of the present invention to at least partially solve the problems in the conventional technology.

A sheet folding apparatus includes: a first sheet conveying unit that holds a part of a sheet to apply conveying force to the sheet; a second sheet conveying unit that is disposed downstream of the first sheet conveying unit in a sheet conveying direction, and holds another part of the sheet to apply conveying force to the sheet; a folded part forming unit that forms a folded part on the sheet by nipping a curved portion formed on a part of the sheet between the first sheet conveying unit and the second sheet conveying unit, the curved portion being formed by holding a part of the sheet by the first sheet conveying unit and applying conveying force to the sheet to reverse the sheet upstream in the sheet conveying direction by the second sheet conveying unit; and a sheet leading end detection unit that detects a leading end of a sheet and is disposed downstream of the second sheet conveying unit in the sheet conveying direction or at almost same position as the second sheet conveying unit. The sheet is conveyed based on a detection timing of the sheet leading end detection unit such that the leading end of the sheet protrudes by a predetermined protrusion amount from the second sheet conveying unit immediately before applying conveying force to the sheet to reverse the sheet.

An image forming apparatus includes: an image forming unit that forms an image on a sheet; and a sheet folding unit that is provided in a body of the image forming apparatus and that performs folding processing on a sheet. The sheet folding apparatus includes: a first sheet conveying unit that holds a part of a sheet to apply conveying force to the sheet; a second sheet conveying unit that is disposed downstream of the first sheet conveying unit in a sheet conveying direction, and holds another part of the sheet to apply conveying force to the sheet; a folded part forming unit that forms a folded part on the sheet by nipping a curved portion formed on a part of the sheet between the first sheet conveying unit and the second sheet conveying unit, the curved portion being formed by holding a part of the sheet by the first sheet conveying unit and applying conveying force to the sheet to reverse the sheet upstream in the sheet conveying direction by the second sheet conveying unit; and a sheet leading end detection unit that detects a leading end of a sheet and is disposed downstream of the second sheet conveying unit in the sheet conveying direction or at almost same position as the second sheet conveying unit, and the sheet is conveyed based on a detection timing of the sheet leading end detection unit such that the leading end of the sheet protrudes by a predetermined protrusion amount from the second sheet conveying unit immediately before applying conveying force to the sheet to reverse the sheet.

An image forming system includes: an image forming apparatus that forms an image on a sheet; and a sheet folding apparatus that is provided separately from the image forming apparatus and that performs folding processing on a sheet on which an image is formed by the image forming apparatus. The sheet folding apparatus includes: a first sheet conveying unit that holds a part of a sheet to apply conveying force to the sheet; a second sheet conveying unit that is disposed downstream of the first sheet conveying unit in a sheet conveying direction, and holds another part of the sheet to apply conveying force to the sheet; a folded part forming unit that forms a folded part on the sheet by nipping a curved portion formed on a part of the sheet between the first sheet conveying unit and the second sheet conveying unit, the curved portion being formed by holding a part of the sheet by the first sheet conveying unit and applying conveying force to the sheet to reverse the sheet upstream in the sheet conveying direction by the second sheet conveying unit; and a sheet leading end detection unit that detects a leading end of a sheet and is disposed downstream of the second sheet conveying unit in the sheet conveying direction or at almost same position as the second sheet conveying unit, and the sheet is conveyed based on a detection timing of the sheet leading end detection unit such that the leading end of the sheet protrudes by a predetermined protrusion amount from the second sheet conveying unit immediately before applying conveying force to the sheet to reverse the sheet.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes an embodiment in which a folding processing apparatus as a sheet conveying apparatus according to the present invention is applied to an image forming system.

Figure 2:
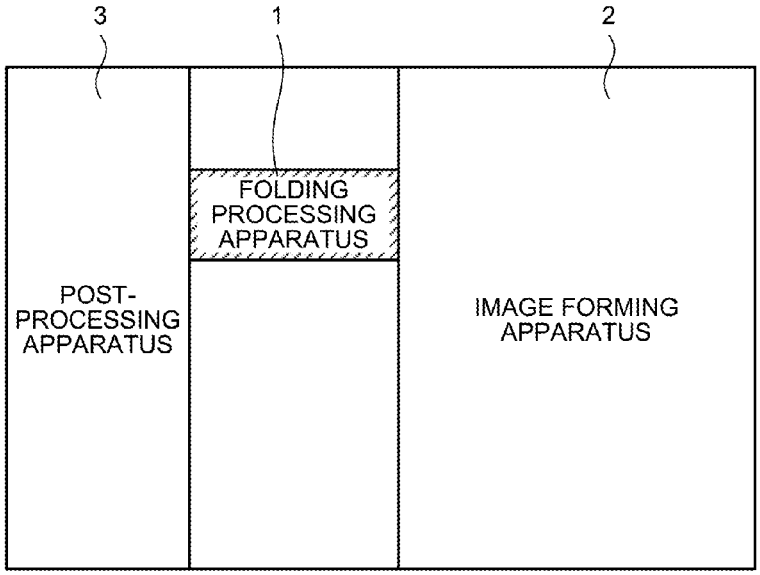
FIG. 2 is an explanatory diagram for explaining an example of an image forming system equipped with a folding processing apparatus according to an embodiment.

FIG. 2 is an explanatory diagram for explaining an example of an image forming system equipped with a folding processing apparatus according to the present embodiment.

A folding processing apparatus 1 of this example is one of sheet post-processing apparatuses that perform post processing on a sheet such as paper discharged from an image forming apparatus 2. The image forming system of this example includes a sheet post-processing apparatus 3 that performs post processing on a sheet on which a folded part is formed by the folding processing apparatus 1, or on a sheet on which a folded part is not formed by the folding processing apparatus 1. The sheet post-processing apparatus 3 is, for example, a punching apparatus that punches a hole in a sheet, a sheet stitching apparatus that stitches a bundle of sheets by, for example, a stapler, or a sorting discharging apparatus that sorts sheets on which an image has been formed and discharges them to a plurality of discharge trays.

Figure 3:
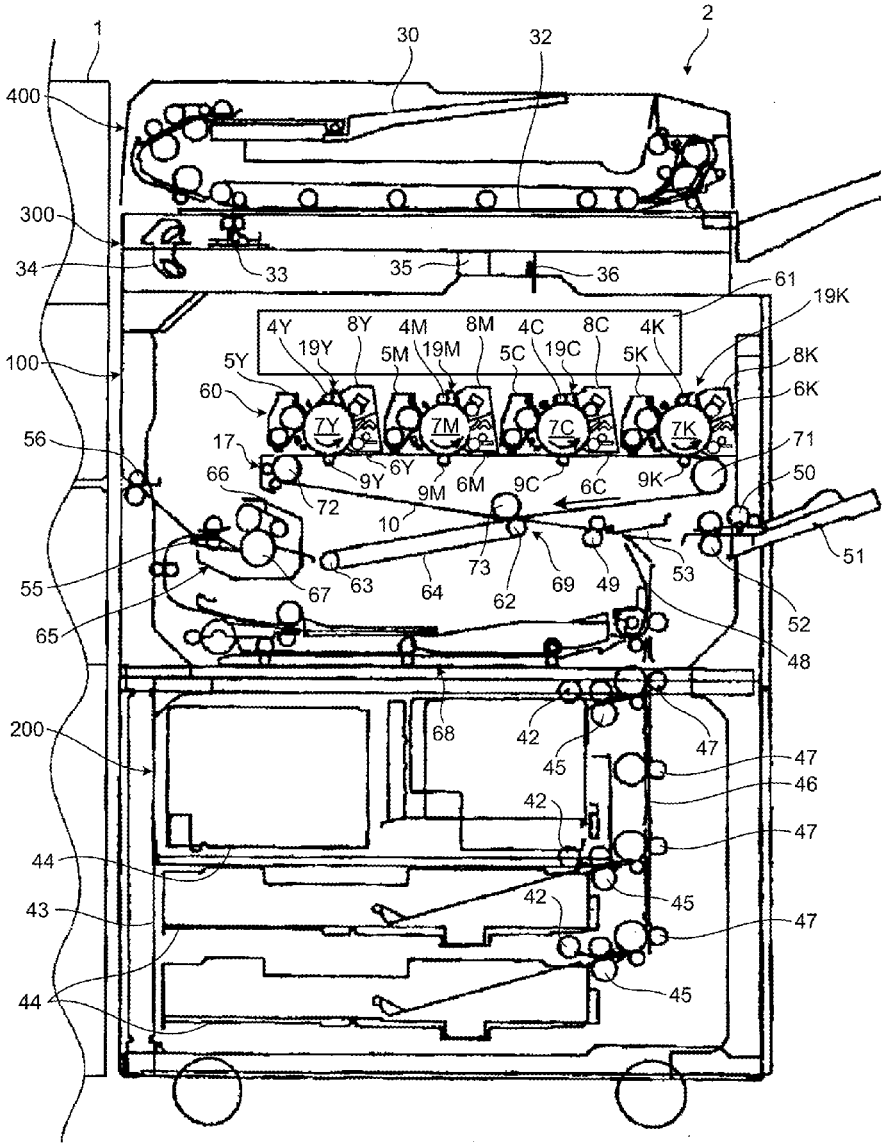
FIG. 3 is a schematic configuration diagram of an image forming apparatus equipped for the image forming system according to the embodiment.

FIG. 3 is a schematic configuration diagram of the image forming apparatus 2 equipped for the image forming system according to the embodiment. The image forming apparatus 2 includes a printer unit 100 that is an apparatus body, a feeding unit 200 that is a feed table, a scanner unit 300 installed on the top of the printer unit 100, and a document conveying unit 400 that is an automatic document feeder (ADF) installed on the top of the scanner unit 300. The image forming apparatus 2 also includes a controller (not illustrated) that controls the operation of each unit in the image forming apparatus 2.

The printer unit 100 includes an intermediate transfer belt 10 as an intermediate transfer member disposed in the middle of the printer unit 100. The intermediate transfer belt 10 is looped over a first supporting roller 71, a second supporting roller 72, and a third supporting roller 73, and a surface of the intermediate transfer belt 10 is movable clockwise. The printer unit 100 also includes four photosensitive element drums 7Y, 7M, 7C, and 7K as latent image carriers that carry toner images having colors of yellow (Y), magenta (M), cyan (C), and black (K), respectively, on the surface. The four photosensitive element drums 7Y, 7M, 7C, and 7K are disposed opposite to the intermediate transfer belt 10.

The printer unit 100 includes charging devices 4Y, 4M, 4C, and 4K as charging units that uniformly charge the surface of the photosensitive element drums 7Y, 7M, 7C, and 7K, and developing devices 5Y, 5M, 5C, and 5K as developing units to form toner images. The charging devices 4Y, 4M, 4C, and 4K and the developing devices 5Y, 5M, 5C, and 5K are disposed around the respective photosensitive element drums 7Y, 7M, 7C, and 7K. The printer unit 100 also includes cleaning devices 6Y, 6M, 6C, and 6K that remove residual toner remaining on the surface of the photosensitive element drums 7Y, 7M, 7C, and 7K after primary transfer, and lubricant applying devices 8Y, 8M, 8C, and 8K that apply lubricant to the surface of the photosensitive element drums.

The photosensitive element drums 7Y, 7M, 7C, and 7K, the developing devices 5Y, 5M, 5C, and 5K, the charging devices 4Y, 4M, 4C, and 4K, and the cleaning devices 6Y, 6M, 6C, and 6K constitute image forming devices 19Y, 19M, 19C, and 19K, respectively, as toner image forming units. The four image forming devices 19Y, 19M, 19C, and 19K are disposed laterally to constitute a tandem image forming unit 60.

A belt cleaning device 17 that removes residual toner remaining on the intermediate transfer belt 10 after transferring a toner image to a sheet P as a recording member is disposed opposite to the third supporting roller 73 across the intermediate transfer belt 10. The printer unit 100 also includes an exposing device 61 above the tandem image forming unit 60.

Primary transfer rollers 9Y, 9M, 9C and 9K are disposed inside the intermediate transfer belt 10. The primary transfer rollers 9Y, 9M, 9C and 9K are disposed opposite to the photosensitive element drums 7Y, 7M, 7C, and 7K, respectively, across the intermediate transfer belt 10 in a manner in which the primary transfer rollers 9Y, 9M, 9C and 9K press the photosensitive element drums 7Y, 7M, 7C, and 7K, respectively, to form a primary transfer unit.

A secondary transfer device 69 is disposed opposite to the tandem image forming unit 60 across the intermediate transfer belt 10. The secondary transfer device 69 is constituted of a secondary transfer roller 62, a secondary transfer belt tension roller 63, and a secondary transfer belt 64 that is looped over the secondary transfer roller 62 and the secondary transfer belt tension roller 63. In the secondary transfer device 69, the secondary transfer belt 64 is pressed to the third supporting roller 73 via the intermediate transfer belt 10 at a position at which the secondary transfer roller 62 supports the secondary transfer belt 64. The secondary transfer device 69 is disposed such that the secondary transfer belt 64 and the intermediate transfer belt 10 form a secondary transfer nip unit as a secondary transfer unit therebetween.

The printer unit 100 includes a fixing device 65 disposed on the left of the secondary transfer device 69 in FIG. 3. The fixing device 65 fixes a transferred image on the sheet P. The fixing device 65 includes a fixing belt 66 that is an endless belt and a pressing roller 67 disposed such that it pushes the fixing belt 66. The secondary transfer device described above also has a sheet conveying function to convey the sheet P on which the toner image is transferred at the secondary transfer nip unit to the fixing device 65. As a secondary transfer device, a transfer roller or a contactless charger may be disposed, but it will be difficult for such a secondary transfer device to have the sheet conveying function as well.

The printer unit 100 includes a sheet reversing device 68 disposed below the secondary transfer device and the fixing device 65 and disposed parallel to the tandem image forming unit 60. The sheet reversing device 68 reverses the sheet P to record images on both surfaces thereof. After an image is fixed on one surface of the sheet P, a switching claw switches a direction in which the sheet P is conveyed to the direction toward the sheet reversing device. The sheet P is reversed at the sheet reversing device 68 and conveyed again to the secondary transfer nip unit. After a toner image is transferred on the other surface of the sheet P, the sheet P can be discharged to the folding processing apparatus 1.

The scanner unit 300 scans image information on a document placed on an exposure glass 32 with a read sensor 36, and transfers the scanned image information to the controller of the image forming apparatus 2.

This controller (not illustrated) controls a light source (not illustrated) such as a laser or a light-emitting diode (LED) disposed in the exposing device 61 of the printer unit 100 to irradiate the photosensitive element drums 7Y, 7M, 7C, and 7K with laser writing light L on the basis of the image information received from the scanner unit 300. With the irradiation, an electrostatic latent image is formed on each surface of the photosensitive element drums 7Y, 7M, 7C, and 7K and then, each latent image is developed into a toner image after a predetermined developing process.

The feeding unit 200 includes a plurality of feeding cassettes 44 stacked in a paper bank 43, feeding rollers 42 that draw sheets P from the feeding cassettes, separating rollers 45 that separate the drawn sheets P and send out to a feed path 46, and conveying rollers 47 to convey a sheet P to a feed path 48.

Because manual feed is also available in the image forming apparatus 2 according to the present embodiment, the image forming apparatus 2 also includes, other than the feeding unit 200, a manual feed tray 51 for manual feed, and a separating roller 52 that separates sheets P on the manual feed tray 51 one by one for a manual feed path 53. The manual feed tray 51 and the separating roller 52 are disposed at a side surface of the image forming apparatus 2.

A registration roller 49 discharges one sheet of the sheets P stored in the feeding cassettes 44 or placed on the manual feed tray 51, and sends the sheet to the secondary transfer nip unit formed between the intermediate transfer belt 10 as the intermediate transfer unit, and the secondary transfer device.

To make a copy of a color image with the image forming apparatus 2 according to the embodiment, a document is set on a document table 30 in the document conveying unit 400. Alternatively, the document conveying unit 400 is first opened so as to set a document on a contact glass 32 in the scanner unit 300 and the document conveying unit 400 is then closed so as to retain the document.

When a document is set in the document conveying unit 400, the document is first conveyed to the top of the exposure glass 32 when a start button (not illustrated) is pressed, and then the scanner unit 300 is driven to run a first travelling unit 33 and a second travelling unit 34. When the document is set on the exposure glass 32, the scanner unit 300 is driven to run the first travelling unit 33 and the second travelling unit immediately after the start button (not illustrated) is pressed. The first travelling unit 33 emits light from a light source to a document surface. The first travelling unit 33 reflects light that has been reflected on the document surface, and the light travels to the second travelling unit 34. The light is reflected on a mirror of the second travelling unit 34, and then passes through an imaging lens 35 to enter the read sensor 36, which reads image information of the document.

The charging devices 4Y, 4M, 4C, and 4K uniformly charge the surface of the photosensitive element drums 7Y, 7M, 7C, and 7K. Color separation is performed on the image information scanned at the scanner unit 300, and then the exposing device 61 performs laser writing of the image information in respective colors on the photosensitive element drums 7Y, 7M, 7C, and 7K. Electrostatic latent images are thus formed on the surface of the respective photosensitive element drums 7Y, 7M, 7C, and 7K.

An image forming process for Y (yellow) will be described as an example. An electrostatic latent image formed on the surface of the photosensitive element drum 7C is developed by the developing device 5Y that develops the latent image with the Y toner, so that a single color toner image is formed. In the same manner, the image forming devices 19M, 19C, and 19K form single-color toner images for M (magenta), C (cyan) and K (black) in this order on the photosensitive element drums 7M, 7C, and 7K, respectively. In this image forming process, toner images are formed on the respective photosensitive element drums 7Y, 7M, 7C, and 7K, and one roller of the four feeding rollers is driven to convey a sheet P having a size depending on the image information.

At the same time, one roller of the first supporting roller 71, the second supporting roller 72 and the third supporting roller 73 is rotationally driven by a driving motor (not illustrated), and the other two rollers perform idle rotation, whereby the intermediate transfer belt 10 is rotationally conveyed. While the intermediate transfer belt 10 is conveyed, the single color toner images on the respective photosensitive element drums 7Y, 7M, 7C, and 7K are sequentially transferred on the intermediate transfer belt 10, thereby forming a superimposed color image thereon.

In the feeding unit 200, one roller of the feeding rollers 42 is selected to rotate, so that the feeding roller 42 draws sheets P from one of the feeding cassettes 44. The sheets P are separated one by one by a separating roller 45 and fed to the feed path 46. The sheet P is then led to the feed path 48 by the conveying rollers 47, and abuts to the registration roller 49 to stop.

Otherwise, sheets P on the manual feed tray 51 are drawn by rotation of a feed roller 50, and are separated one by one by the separating roller 52. The sheet P is fed into the manual feed path 53, and abuts to the registration roller 49 to stop.

When sheets P on the manual feed tray 51 are used, the sheets P on the manual feed tray 51 are drawn by rotation of a feed roller 50, and are separated one by one by the separating roller 52. The sheet P is fed into the manual feed path 53, and abuts to the registration roller 49 to stop.

The registration roller 49 rotates in synchronization with the superimposed color image on the intermediate transfer belt 10, and feeds the sheet P to the secondary transfer nip unit at which the intermediate transfer belt 10 and the secondary transfer roller 62 contact with each other. The superimposed color image is secondary transferred from the surface of the intermediate transfer belt 10 onto the sheet P by effects of a transfer electric field and a contact pressure generated at the secondary transfer nip, so that the color image is recorded on the sheet P.

After the transfer of the color image onto the sheet P at the secondary transfer nip unit, the sheet P is fed to the fixing device 65 by the secondary transfer belt 64 of the secondary transfer device 69. At the fixing device 65, the pressing roller 67 and the fixing belt apply pressure and heat to the sheet P, thereby fixing the color image on the sheet P. The sheet P is then discharged by a discharge roller 56 to the folding processing apparatus 1.

In a case of duplex printing, after the color image is fixed on one surface of the sheet P, the sheet P is switched by the switching claw 55 such that the sheet P is conveyed to the sheet reversing device 68, where the sheet P is reversed to enter into the secondary transfer nip unit again. After another color image is recorded on the other surface of the sheet P at the secondary transfer nip unit, the sheet P is discharged to the folding processing apparatus 1 by the discharge roller 56.

Residual toner that remains on the surface the intermediate transfer belt after transferring the color image onto the sheet P at the secondary transfer nip unit is removed by the belt cleaning device 17 to prepare for the next image forming by the tandem image forming unit 60.

Figure 4:
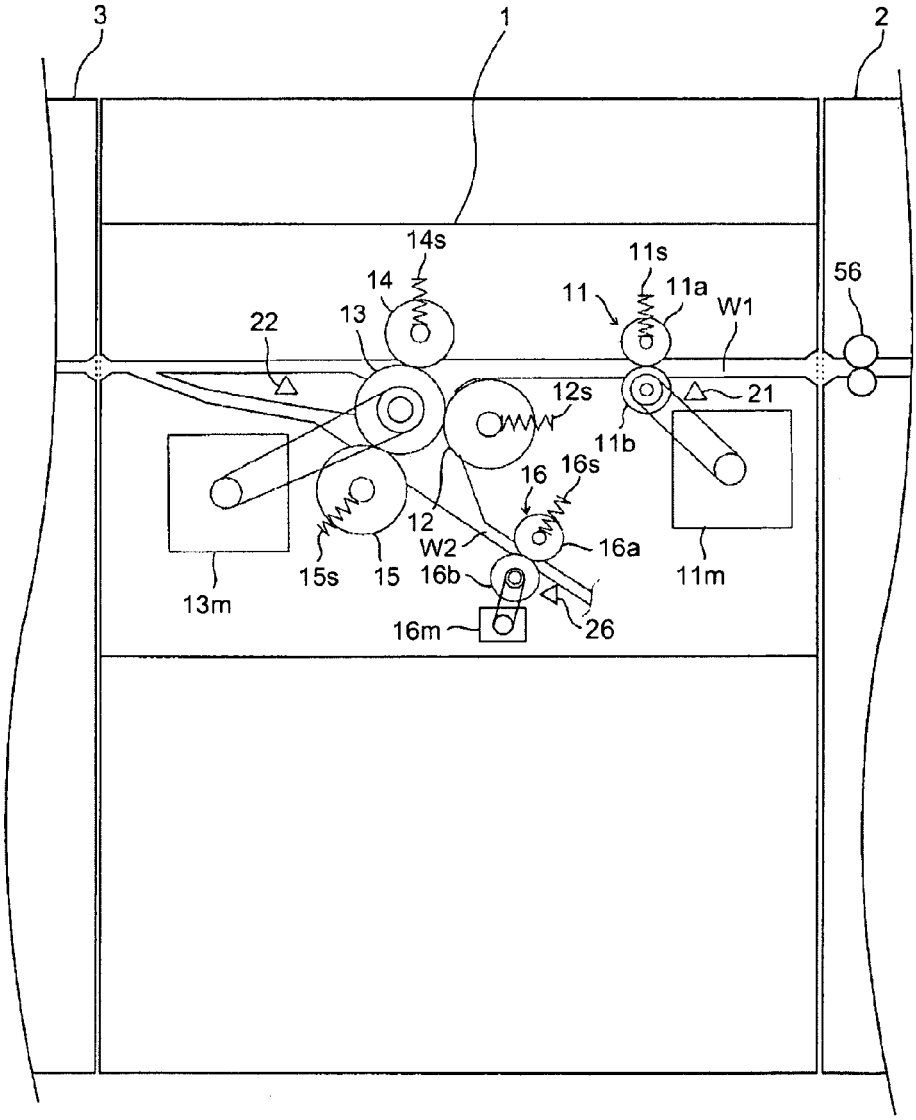
FIG. 4 is a schematic configuration diagram of the folding processing apparatus equipped for the image forming system according to the embodiment.

FIG. 4 is a schematic configuration diagram of the folding processing apparatus 1 equipped for the image forming system according to the embodiment.

The folding processing apparatus 1 according to the present embodiment includes a through conveying path W1 through which the sheet P discharged from the image forming apparatus 2 is conveyed to the sheet post-processing apparatus 3 without performing folding processing. The folding processing apparatus 1 also includes a branch conveying path W2 that branches from the through conveying path W1. In the branch conveying path W2, folding processing is performed on the sheet P discharged from the image forming apparatus 2 and through which the sheet P is conveyed to the sheet post-processing apparatus 3.

A pair of entrance rollers 11 as a first sheet conveying unit is disposed on an entrance side (on the right in FIG. 4) of the through conveying path W1 from which the sheet P discharged from the image forming apparatus 2 enters. The pair of entrance rollers 11 is composed of a pressing roller 11*a* as a rotation member, and a driving roller 11*b* as an opposite member. The driving roller 11*b* is rotationally driven by the driving force of an entrance motor 11*m* as a driving source.

On an exit side (on the left in FIG. 4) of the through conveying path W1, disposed are a first folding roller 12, a first forward reverse rotation roller 13 disposed in contact with the first folding roller 12, and a pressing roller 14 disposed in contact with the first forward reverse rotation roller 13. The sheet P can move from the through conveying path W1 to the branch conveying path W2 through a nip between the first folding roller 12 and the first forward reverse rotation roller 13. The sheet P can be conveyed to the sheet post-processing apparatus 3 through the through conveying path W1 by passing through a nip between the first forward reverse rotation roller 13 and the pressing roller 14.

The folding processing apparatus 1 according to the present embodiment includes a second folding roller 15 disposed in contact with the first forward reverse rotation roller 13 on an exit side of the branch conveying path W2. On the branch conveying path W2, a pair of second forward reverse rotation rollers 16 is disposed opposite to the second folding roller 15 across the nip between the first folding roller 12 and the first forward reverse rotation roller 13 through which the sheet P enters from the through conveying path W1. The pair of second forward reverse rotation rollers 16 is composed of a pressing roller 16*a* as a rotation member, and a driving roller 16*b* as an opposite member. The driving roller 16*b* is rotationally driven by the driving force of a second forward reverse rotation motor 16*m* as a driving source.

The first forward reverse rotation roller 13 can be rotationally driven in both directions of forward and reverse rotation by the driving force of the first forward reverse rotation motor 13*m* that can rotate in both directions of forward and reverse rotation. The first folding roller 12, the pressing roller 14, and the second folding roller 15 each disposed in contact with the first forward reverse rotation roller 13 are driven rollers that are rotationally driven by the rotation of the first forward reverse rotation roller 13.

The driving roller 16*b* of the pair of second forward reverse rotation rollers 16 can be rotationally driven in both directions of forward and reverse rotation by the driving force of the second forward reverse rotation motor 16*m* that can rotate in both directions of forward and reverse rotation. The pressing roller 16*a* of the pair of second forward reverse rotation rollers 16 is a driven roller that is rotationally driven by the rotation of the driving roller 16*b*.

According to the present embodiment, at all the driven rollers, pressing springs 11*s*, 12*s*, 14*s*, 15*s*, and 16*s* as biasing units apply bias to roller shafts of the respective driven rollers, thereby forming nips between the driven rollers and the rollers opposite to the driven rollers.

The folding processing apparatus 1 of the present embodiment includes an entrance sensor 21 as a sheet end portion detection unit for detecting an end portion of the sheet P. The entrance sensor 21 is disposed upstream of (closer to the entrance of the through conveying path W1 than) the pair of entrance rollers 11 in the sheet conveying direction. When a leading end of the sheet P conveyed from the image forming apparatus 2 arrives at a detection region of the entrance sensor 21, the entrance sensor 21 outputs a leading end detection signal indicating the arrival of the leading end of the sheet P to a controller (not illustrated). Various known sensors can be used as the entrance sensor 21.

The folding processing apparatus 1 of the present embodiment also includes a sheet detection sensor 22 as a sheet leading end detection unit for detecting the leading end of the sheet P. The sheet detection sensor 22 is disposed downstream of (closer to the exit of the through conveying path W1 than) the second sheet conveying unit composed of the first forward reverse rotation roller 13 and the pressing roller 14 in the sheet conveying direction. When the leading end of the sheet P conveyed in the through conveying path W1 arrives at a detection region of the sheet detection sensor 22, the sheet detection sensor 22 outputs a leading end detection signal indicating the arrival of the leading end of the sheet P to the controller (not illustrated). Various known sensors can be used as the sheet detection sensor 22 as in the case of the entrance sensor 21 described above.

The folding processing apparatus 1 of the present embodiment includes a sheet detection sensor 26 for detecting a leading end of the sheet P. The sheet detection sensor 26 is disposed downstream of (opposite to the exit of the branch conveying path W2 across) the pair of second forward reverse rotation rollers 16 in the sheet conveying direction. When the leading end of the sheet P sent from the through conveying path W1 to the branch conveying path W2 arrives at a detection region of the sheet detection sensor 26, the sheet detection sensor 26 outputs a leading end detection signal indicating the arrival of the leading end of the sheet P to the controller (not illustrated). Various known sensors can be used as the sheet detection sensor 26 as in the cases of the entrance sensor 21 and the sheet detection sensor 22 described above.

In the present embodiment, the first forward reverse rotation roller 13 and the pressing roller 14 constitute the second sheet conveying unit, and the first folding roller 12 and the first forward reverse rotation roller 13 constitute the folded part forming unit. The first forward reverse rotation roller 13 and the second folding roller 15 also constitute the folded part forming unit in the present embodiment.

The second sheet conveying unit may be configured by using an adhesive roller or an absorption belt rather than a pair of rollers. In the present embodiment, the first forward reverse rotation roller 13 is shared by the second sheet conveying unit and the folded part forming unit. However, the present embodiment is not limited to this. The second sheet conveying unit and the folded part forming unit may be configured independently by using separate rollers.

Next, described is the procedure of the operation of folding processing performed by the folding processing apparatus 1 to form a folded part on the sheet P.

Figure 5A:
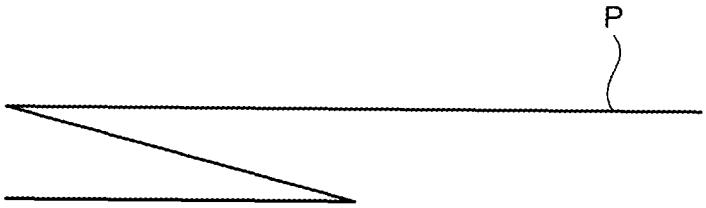
FIGS. 5A to 5C are explanatory diagrams each illustrating an example of folded parts formed through folding processing performed by the folding processing apparatus.
Figure 5B:
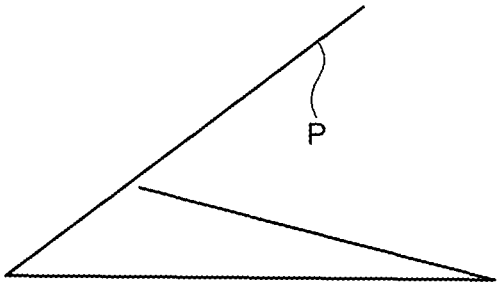
Figure 5C:
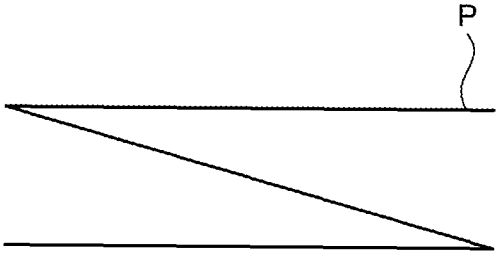

FIGS. 5A to 5C are explanatory diagrams each illustrating an example of folded parts formed through folding processing performed by the folding processing apparatus 1 according to the present embodiment.

The folding processing apparatus 1 according to the present embodiment can perform z-shaped fold processing in which two outer folded parts are formed on the sheet P to make a z-shaped fold as illustrated in FIG. 5A. The folding processing apparatus 1 according to the present embodiment can perform inner-threefold processing in which two inner folded parts are formed on the sheet P such that the folded parts divide the sheet P into three nearly equal parts as illustrated in FIG. 5B. The folding processing apparatus 1 according to the present embodiment can perform outer-threefold processing in which two outer folded parts are formed on the sheet P such that the folded parts divide the sheet P into three nearly equal parts as illustrated in FIG. 5C.

FIGS. 6A to 6H are explanatory diagrams for explaining the general procedure of z-shaped folding processing performed by the folding processing apparatus 1.

Figure 6A:
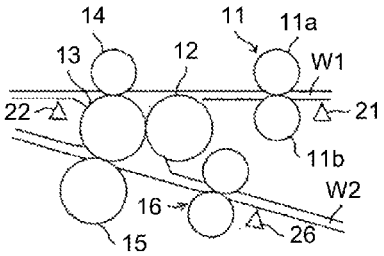
FIGS. 6A to 6H are explanatory diagrams for explaining the general procedure of z-shaped folding processing performed by the folding processing apparatus.
Figure 6B:
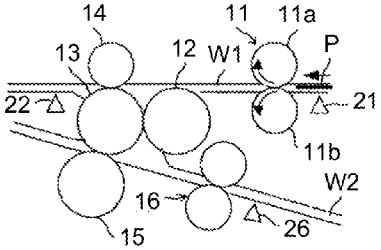
Figure 6C:
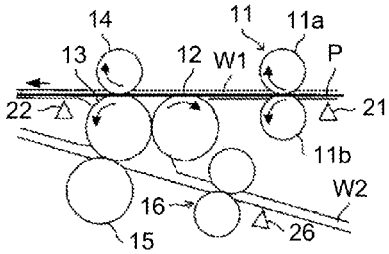

The leading end of the sheet P that is conveyed by being applied with conveying force by a discharge roller (not illustrated) of the image forming apparatus 2 is first detected by the entrance sensor 21. When the controller (not illustrated) receives a leading end detection signal thereby output from the entrance sensor 21, the controller controls the entrance motor 11*m* to start rotation of the pair of entrance rollers 11 (FIGS. 6A and 6B). When the leading end of the sheet P enters into the nip between the pair of entrance rollers 11, the sheet P also receives conveying force from the pair of entrance rollers 11, and is conveyed in the through conveying path W1 toward the exit thereof.

The leading end of the sheet P conveyed in the through conveying path W1 enters into the nip between the first forward reverse rotation roller 13 and the pressing roller 14. After passing through the nip, the leading end of the sheet P is detected by the sheet detection sensor 22. The controller receives a leading end detection signal from the sheet detection sensor 22 that detects the leading end of the sheet P, and performs control in the following manner. That is, when the leading end of the sheet P protrudes from the nip position between the first forward reverse rotation roller 13 and the pressing roller 14 by a predetermined protrusion amount (FIG. 6C), the controller controls the first forward reverse rotation motor 13*m* to stop the rotation of the first forward reverse rotation roller 13. At the same time, the controller controls the entrance motor 11*m* to stop the rotation of the driving roller 11*b* of the pair of entrance rollers 11.

The protrusion amount is determined each time depending on the length of the sheet P in the sheet conveying direction, and the content of the folding processing (such as a folding type). The protrusion amount of the leading end of the sheet P can be grasped, for example, by a reception timing of the leading end detection signal output from the sheet detection sensor 22 and an amount of rotation of the pressing roller 14.

Figure 6D:
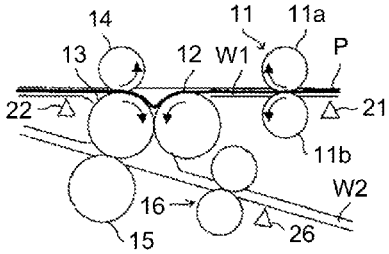
Figure 6E:
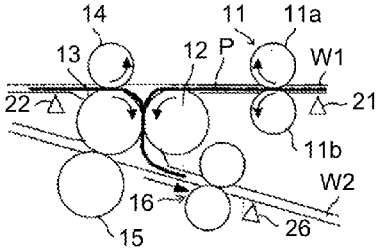
Figure 6F:
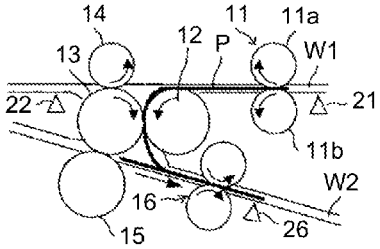

The controller then controls the first forward reverse rotation motor 13*m* to start reverse rotation of the first forward reverse rotation roller 13 in a direction in which the sheet P is backed toward the entrance of the through conveying path W1, and also starts rotation of the pair of entrance rollers 11. Bend is thus formed on a part of the sheet between the pair of entrance rollers 11 and the first forward reverse rotation roller 13 (FIG. 6D). This bent portion (curved portion) enters into the nip between the first folding roller 12 and the first forward reverse rotation roller 13, thereby forming a first folded part in the curved portion. After passing through the nip between the first folding roller 12 and the first forward reverse rotation roller 13, the first folded part enters the branch conveying path W2 (FIG. 6E), and the sheet P is conveyed in the branch conveying path W2 toward the pair of second forward reverse rotation rollers 16.

The first folded part of the sheet P enters into the nip between the pair of second forward reverse rotation rollers 16. After passing through the nip, the first folded part is detected by the sheet detection sensor 26. The controller receives a leading end detection signal from the sheet detection sensor 26 that detects the first folded part of the sheet P, and performs control in the following manner. That is, when the first folded part of the sheet P protrudes from the nip position between the pair of second forward reverse rotation rollers 16 by a predetermined protrusion amount (FIG. 6F), the controller controls the first forward reverse rotation motor 13*m* to stop rotation of the first forward reverse rotation roller 13. At the same time, the controller stops the rotation of the pair of second forward reverse rotation rollers 16 and the pair of entrance rollers 11. The protrusion amount at this time is also determined each time depending on the length of the sheet P in the sheet conveying direction, and the content of the folding processing (such as a folding type). The protrusion amount of the first folded part of the sheet P can be grasped, for example, by a reception timing of the leading end detection signal output from the sheet detection sensor 26 and an amount of rotation of the pair of second forward reverse rotation rollers 16.

Figure 6G:
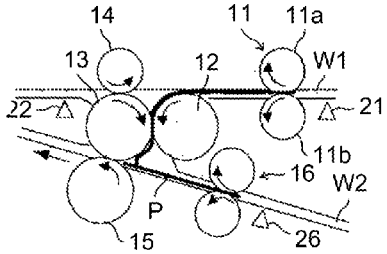

The controller then controls the second forward reverse rotation motor 16*m* to start reverse rotation of the pair of second forward reverse rotation rollers 16 in a direction in which the sheet P is conveyed toward the exit of the branch conveying path W2. The controller also resumes reverse rotation of the first forward reverse rotation roller 13, and resumes rotation of the pair of entrance rollers 11. Bend is thus formed on a part of the sheet between the first forward reverse rotation roller 13 and the pair of second forward reverse rotation rollers 16 (FIG. 6G). This bent portion (curved portion) enters into the nip between the first forward reverse rotation roller 13 and the second folding roller 15, thereby forming a second folded part in the curved portion.

Figure 6H:
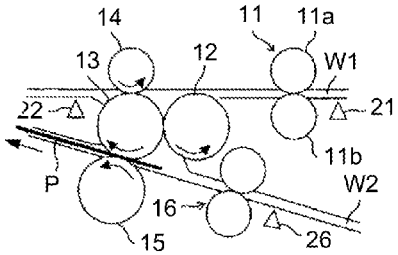
Figure 7A:
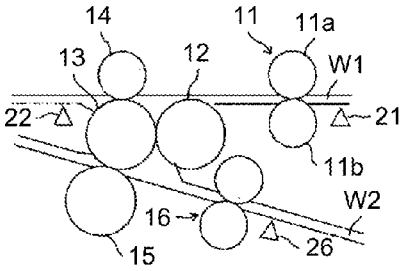
FIGS. 7A to 7H are explanatory diagrams for explaining the general procedure of inner-threefold processing performed by the folding processing apparatus.
Figure 7B:
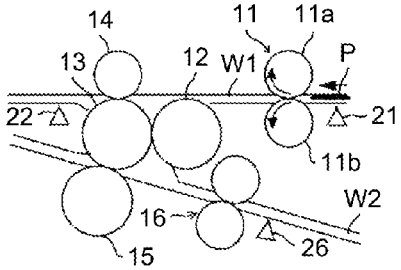
Figure 7C:
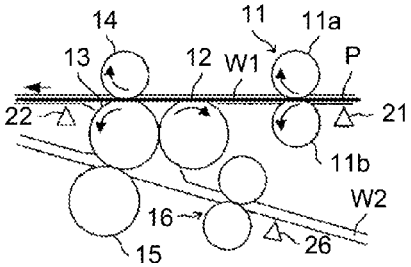
Figure 7D:
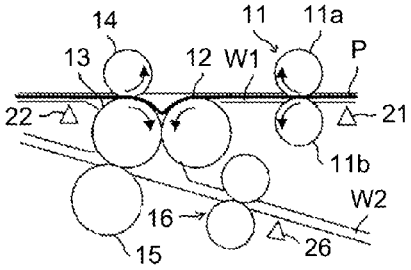
Figure 7E:
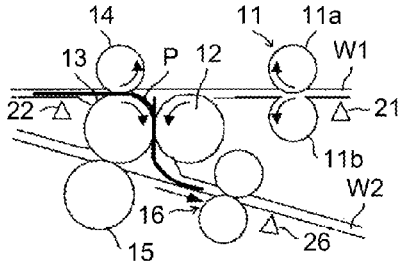
Figure 7F:
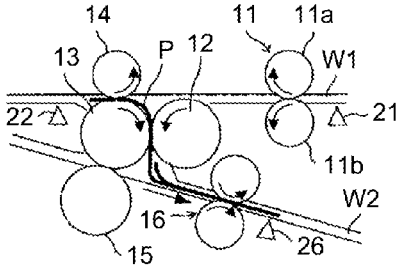
Figure 7G:
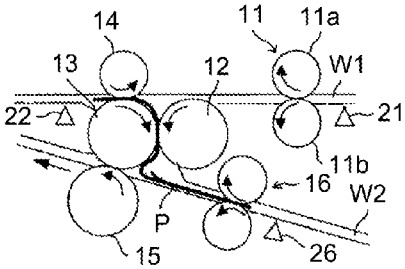
Figure 7H:
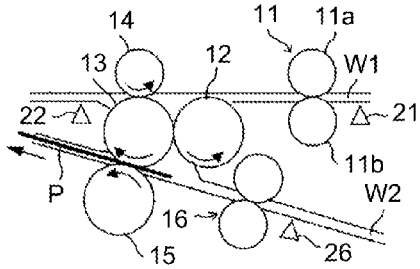
Figure 8A:
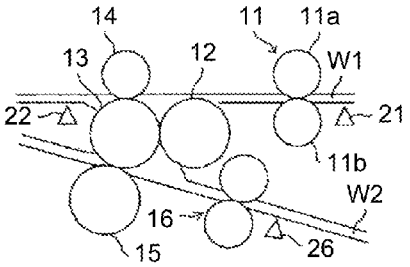
FIGS. 8A to 8H are explanatory diagrams for explaining the general procedure of outer-threefold processing performed by the folding processing apparatus.
Figure 8B:
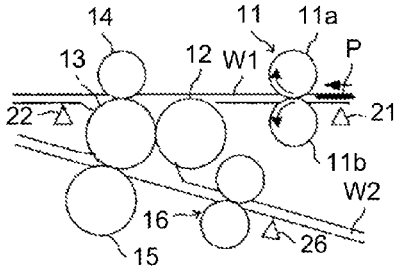
Figure 8C:
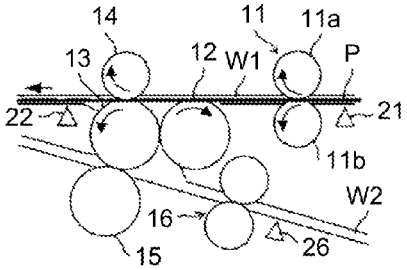
Figure 8D:
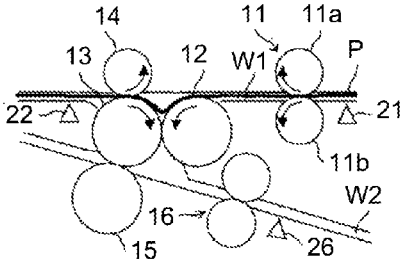
Figure 8E:
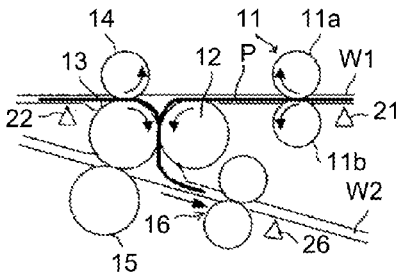
Figure 8F:
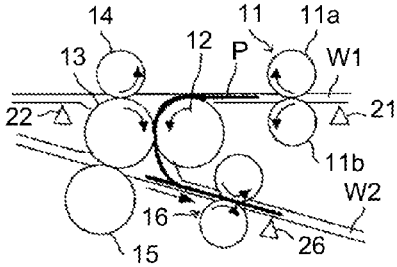
Figure 8G:
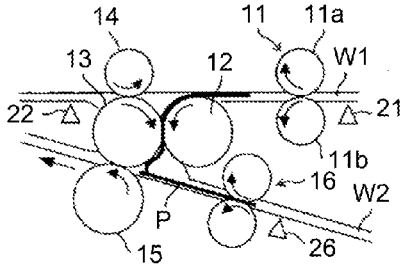
Figure 8H:
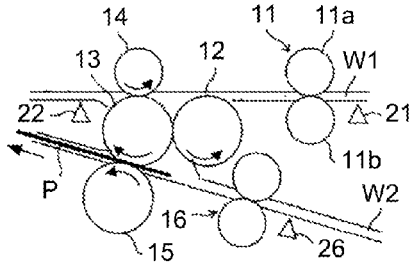

After the second folded part passes through the nip between the first forward reverse rotation roller 13 and the second folding roller 15, the sheet P is conveyed toward the exit of the branch conveying path W2 (FIG. 6H). The sheet P on which the first and the second folded parts are formed is conveyed to the sheet post-processing apparatus 3 by receiving conveying force from the first forward reverse rotation roller 13.

FIGS. 7A to 7H are explanatory diagrams for explaining the general procedure of inner-threefold processing performed by the folding processing apparatus 1.

FIGS. 8A to 8H are explanatory diagrams for explaining the general procedure of outer-threefold processing performed by the folding processing apparatus 1.

The procedure of the operation of the inner-threefold processing and the outer-threefold processing is similar to that of the z-shaped folding processing, but the above-described protrusion amounts are different depending on the types of the folding processing. That is, the z-shaped folding processing, the inner-threefold processing, and the outer-threefold processing differ in that they have different timings at which reverse rotation of the first forward reverse rotation roller 13 and that of the pair of second forward reverse rotation rollers 16 are started.

Figure 9:
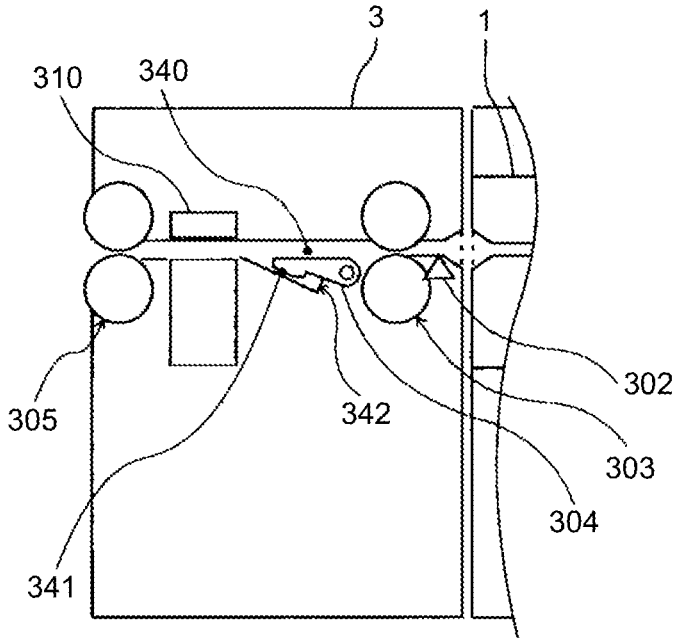
FIG. 9 is a schematic configuration diagram of a sheet post-processing apparatus equipped for the image forming system according to the present embodiment.

FIG. 9 is a schematic configuration diagram of a sheet post-processing apparatus 3 equipped for the image forming system according to the present embodiment.

The sheet post-processing apparatus 3 includes an entrance sensor 302, a pair of entrance rollers 303, a bifurcating claw 304, a pair of discharge rollers 305, a stitching device 310, a conveying path 340, and a branch path 341.

The entrance sensor 302 detects the leading end and the trailing end of the sheet P and the presence or absence of the sheet P.

The pair of entrance rollers 303 is disposed at the entrance of the sheet post-processing apparatus 3, and has a function to introduce the sheet P into the sheet post-processing apparatus 3. Abutting skew correction of the sheet P is possible with a roller nip of the pair of entrance rollers 303. The pair of entrance rollers 303 is driven by a controllable driving source (not illustrated). The driving source is controlled by a controller (not illustrated), and the controller controls the driving source to rotationally drive or stop the pair of entrance rollers 303, so that a conveying amount of the sheet P is controlled by the rotation of the pair of entrance rollers 303. The controller may be provided in the image forming apparatus 2.

The conveying path 340 is a normal path through which the sheet P is conveyed and discharged. The branch path 341 is provided for stacking and aligning the sheets P. The sheet P is reversed to enter the branch path 341 from the trailing end thereof.

The bifurcating claw 304 is a claw member that is rotatably disposed in the conveying path 340 and that switches paths so that the trailing end of the sheet P is introduced from the conveying path 340 into the branch path 341. The bifurcating claw 304 can press the sheet P to the conveying surface of the branch path 341, whereby the sheet P can be fixed.

The stitching device 310 is a device to stitch a sheet bundle that has been aligned in the branch path 341 without using a metallic staple. The stitching device 310 in the present embodiment uses a pair of tooth forms having convex and concave portions on their surfaces to stitch the sheet bundle by pinching it so that sheets P is distorted and fibers thereof are tangled. A stitching device may also be used that cuts a u-shaped slit through the sheet bundle and bends the u-shaped part to insert into a slit that has been cut together with the u-shaped slit near a bent part, so that the sheet bundle is stitched without using a metallic staple. A stitching unit to stitch a sheet bundle is not limited to the stitching device according to the present embodiment, but may be a stitching device that has a common stitching function.

The pair of discharge rollers 305 is disposed at the exit of the sheet post-processing apparatus 3, and has a function to discharge the sheet bundle stitched by the stitching device 310 to a discharge tray (not illustrated). The pair of discharge rollers 305 is driven by a controllable driving source (not illustrated). The driving source is controlled by the controller, and the controller controls the driving source to rotationally drive or stop the pair of discharge rollers 305, so that a conveying amount of the sheet P is controlled by the rotation of the pair of discharge rollers 305.

Figure 10:
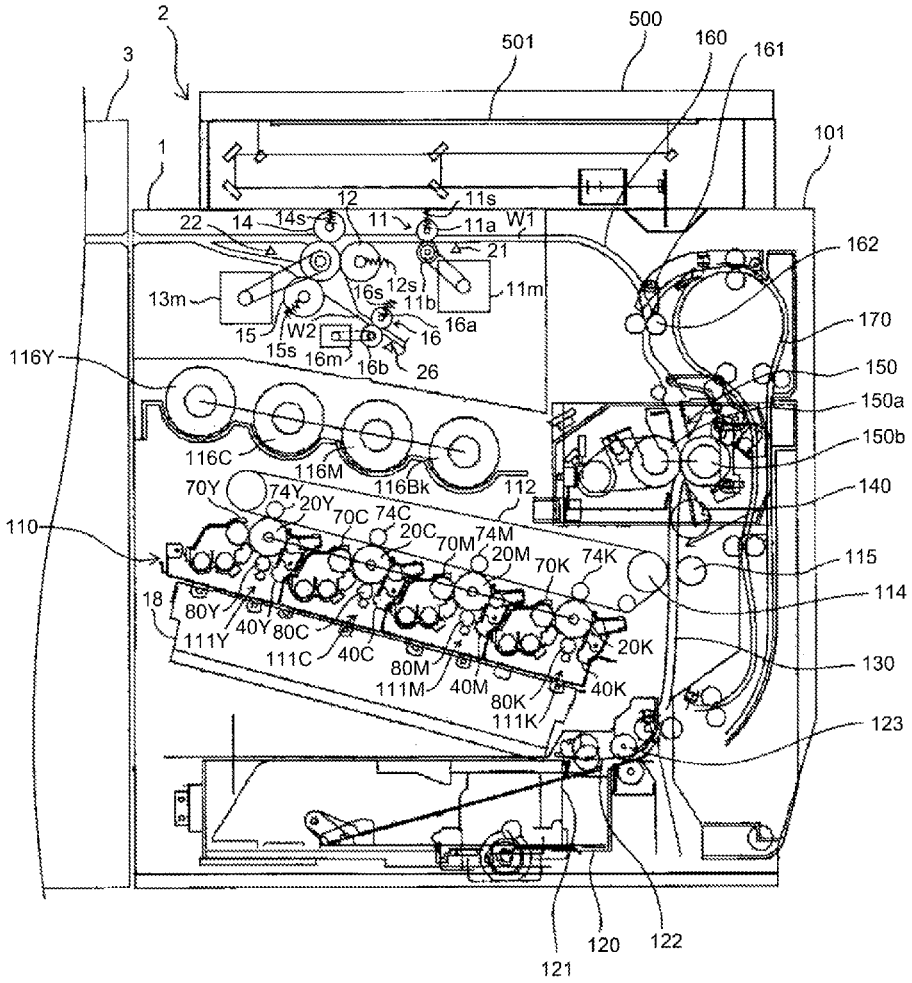
FIG. 10 is an explanatory diagram for explaining another example of the image forming system equipped with the folding processing apparatus according to the embodiment.

FIG. 10 is an explanatory diagram for explaining another example of the image forming system equipped with the folding processing apparatus according to the present embodiment.

The folding processing apparatus 1 according to this example forms a folded part on the sheet P inside the image forming apparatus 2. The image forming system according to this example also includes the sheet post-processing apparatus 3 that performs post processing on either of a sheet P on which a folded part is formed by the folding processing apparatus 1, and a sheet P on which a folded part is not formed by the folding processing apparatus 1.

FIG. 10 is a schematic configuration diagram of the image forming apparatus 2 in which the folding processing apparatus 1 is disposed inside the apparatus body of the image forming apparatus 2. As illustrated in FIG. 10, the image forming apparatus 2 includes an image forming apparatus body 101, the folding processing apparatus 1, and an image reading device 500.

The image forming apparatus body 101 is a tandem color image forming apparatus using an indirect transfer method. The image forming apparatus body 101 includes an image forming unit 110 that is constituted of image forming stations 111Y, 111C, 111M, and 111K in four colors illustrated in almost middle of FIG. 10. Below the image forming unit 110, disposed is an optical writing device 18 adjacent to the image forming unit 110. Below the optical writing device 18, disposed is a feeding unit 120. The image forming apparatus body 101 also includes a feed conveying path (vertical conveying path) 130 that conveys the sheet P fed from the feeding unit 120 to a secondary transfer unit 140 and to a fixing device 150; a discharge conveying path 160 that conveys the sheet P on which an image has been fixed by the fixing device 150 to the folding processing apparatus 1; and a duplex conveying path 170 that reverses the sheet P with an image formed on one surface thereof in order to form another image on the other surface of the sheet P.

The image forming unit 110 includes photosensitive element drums 20Y, 20C, 20M, and 20K in four colors for the image forming stations 111Y, 111C, 111M, and 111K, respectively. Around the periphery of the photosensitive element drums 20Y, 20C, 20M, and 20K, disposed are charging devices 80Y, 80C, 80M, and 80K, developing devices 70Y, 70C, 70M, and 70K, cleaning units 40Y, 40C, 40M, and 40K, and neutralization units (not illustrated), respectively. An intermediate transfer belt 112 is provided to which images formed on the respective photosensitive element drums 20Y, 20C, 20M, and 20K are intermediate transferred by primary transfer rollers 74Y, 74C, 74M, and 74K, respectively. The optical writing device 18 is provided to write images in four colors on the photosensitive element drums 20Y, 20C, 20M, and 20K, respectively.

The optical writing device 18 is disposed below the image forming stations 111Y, 111C, 111M, and 111K, and the intermediate transfer belt 112 is disposed above the image forming stations 111Y, 111C, 111M, and 111K. Above the image forming unit 110, disposed in a replaceable manner are toner containers 116Y, 116C, 116M, and 116K each containing toner that is supplied to the developing devices 70Y, 70C, 70M, and 70K.

The intermediate transfer belt 112 is rotatably supported by a plurality of supporting rollers. At the secondary transfer unit 140, a supporting roller 114 of the supporting rollers is disposed opposite to a secondary transfer roller 115 across the intermediate transfer belt 112, so that an image on the intermediate transfer belt 112 can be secondary transferred to the sheet P.

The detailed description is omitted of the image forming procedure of the tandem color image forming apparatus using an indirect transfer method because it is a well-known technology and the gist of the present invention does not have a direct relation to the image forming procedure thereof.

The feeding unit 120 includes a feed tray 121, a pick-up roller 122, and a feed conveying roller 123. The feeding unit 120 sends a sheet P picked up from the feed tray 121 upward along the feed conveying path 130.

The sent sheet P is conveyed to the secondary transfer unit 140 at which an image is secondary transferred to the sheet P, and then, the sheet P is conveyed to the fixing device 150. The fixing device 150 includes a fixing roller 150*a* and a pressing roller 150*b*. When the sheet P passes through a nip between these rollers, the fixing device 150 applies heat and pressure to the sheet P, thereby fixing toner on the sheet P.

Downstream of the fixing device 150, the conveying path branches at a branching claw 161 to be the discharge conveying path 160 and the duplex conveying path 170 extending in two directions that are selected depending on whether it is a case in which the sheet P is conveyed to the folding processing apparatus 1 or a case in which the sheet P is conveyed to the duplex conveying path 170.

A branch conveying roller 162 is disposed immediately upstream of the bifurcating claw 161, and applies conveying force to the sheet P.

The folding processing apparatus 1 is disposed inside the image forming apparatus body 101, and performs folding processing on the sheet P conveyed from the image forming apparatus body 101 after an image is formed thereon, and discharges the sheet P to the sheet post-processing apparatus 3 illustrated in FIG. 10.

The image reading device 500 is a technically well-known device that reads an image on a document set on an exposure glass 501 through optical scan. The configuration and function of the image reading device 500 is well known and the gist of the present invention does not have a direct relation to it, thus detailed description thereof is omitted.

The image forming apparatus body 101 thus configured generates image data used for writing on the basis of document data that has been read by the image reading device 500, or print data that has been transferred from an external apparatus such as a personal computer. On the basis of the image data, the optical writing device 18 performs optical writing on the photosensitive element drums 20Y, 20C, 20M, and 20K. Images of respective four colors are formed at the respective image forming stations 111Y, 111C, 111M, and 111K, and are sequentially transferred on the intermediate transfer belt 112, thereby forming a color image with four colors that are superimposed on the intermediate transfer belt 112.

In conjunction with the image forming described above, a sheet P is fed from the feed tray 121. The sheet P is stopped temporarily at the position of a registration roller (not illustrated) immediately before the secondary transfer unit 140, and then sent out in synchronization with the leading edge of the image on the intermediate transfer belt 112. The image is secondary transferred to the sheet P at the secondary transfer unit 140, and the sheet P is sent to the fixing device 150.

The fixing device 150 fixes the image on the sheet P, and then, the sheet P is conveyed to the discharge conveying path 160 by the switching operation by the bifurcating claw 161 in a case of single-sided printing, or in a case in which printing on both surfaces of the sheet P is completed in duplex printing mode. The sheet P is conveyed to the duplex conveying path 170 in a case in which printing on the second surface of the sheet P is to be performed in duplex printing mode.

The sheet P conveyed to the duplex conveying path 170 is reversed therein, and sent again to the secondary transfer unit 140. After another image is formed on the other surface of the sheet P, the sheet P is sent back to the discharge conveying path 160.

The sheet P thus conveyed to the discharge conveying path 160 is then conveyed to the folding processing apparatus 1. After receiving folding processing, or without receiving folding processing in the folding processing apparatus 1, the sheet P is discharged to the sheet post-processing apparatus 3.

The image forming system uses the sheet post-processing apparatus 3 illustrated in FIG. 9, thus detailed description thereof is omitted.

First Configuration Example

Figure 1:
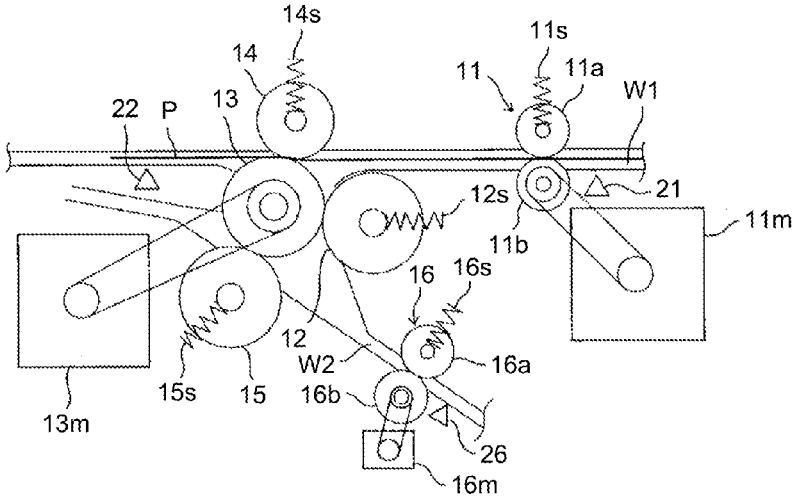
FIG. 1 is a schematic diagram illustrating main units of a folding processing apparatus according to a first configuration example.

FIG. 1 is a schematic diagram illustrating main units of a folding processing apparatus 1 according to a first configuration example.

In FIG. 1, a sheet P sent from an image forming apparatus passes through the pair of entrance rollers 11 to the pressing roller 14. When the leading end of the sheet P passes through the pressing roller 14 and protrudes from the pressing roller 14 by a predetermined protrusion amount that is calculated on the basis of a folding position, the pressing roller 14 is stopped and then reversed. Assume that the direction causing downstream movement is referred to as a forward direction. When the pair of entrance rollers 11 rotates in the forward direction, and the pressing roller 14 rotates in the reverse direction, bend can be formed on the sheet P between the pair of entrance rollers 11 and the pressing roller 14. The bend is nipped by the nip between the first forward reverse rotation roller 13 and the first folding roller 12, thereby performing folding processing.

The protrusion amount calculated on the basis of a folding position is determined by considering a desired position at which the sheet P is folded, a value obtained by geometrical relations of roller configurations, and an adjustment value obtained by experiments. The adjustment value is a value obtained through experiments by quantifying offset amounts of folding positions that vary because of differences such as the thickness or the type of the sheet P.

As described above, the folding position is determined by the protrusion amount from the pressing roller 14. As the protrusion amount varies, the folding position also varies.

Figure 11:
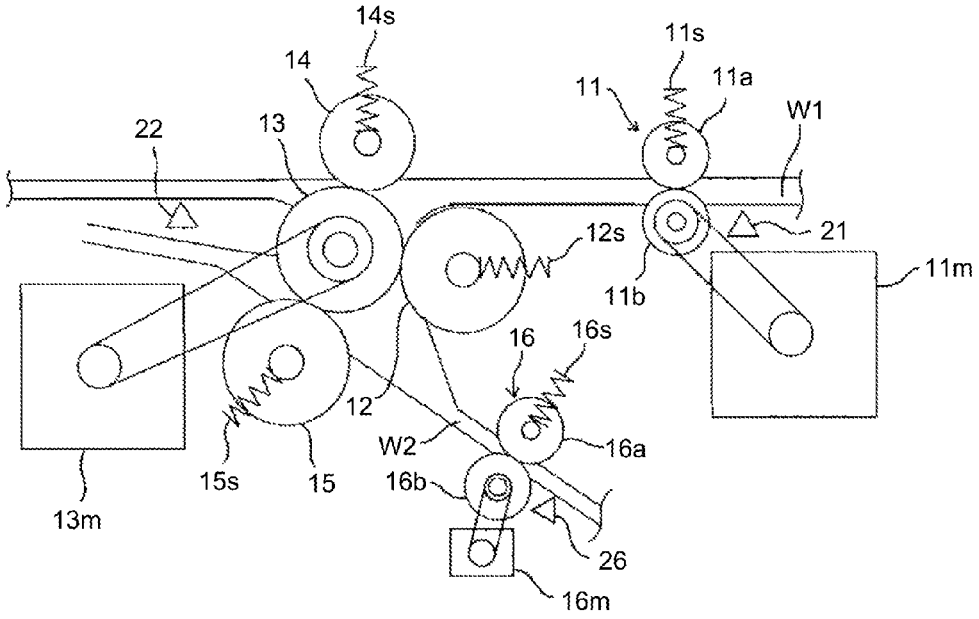
FIG. 11 is a schematic diagram illustrating an example of main units of a folding processing apparatus according to a comparative example.

FIG. 11 is a schematic diagram illustrating an example of main units of a folding processing apparatus according to a comparative example. The folding processing apparatus according to the comparative example does not include the sheet detection sensor 22 that is included in the folding processing apparatus according to the first configuration example illustrated in FIG. 1 and that is disposed downstream of the pressing roller 14 in the sheet conveying direction.

Accordingly, the folding processing apparatus according to the comparative example illustrated in FIG. 11 stops the sheet P or starts reverse rotation of the pressing roller 14 on the basis of detection of the leading end of the sheet by the entrance sensor 21. For example, the folding processing apparatus stops the sheet P after X1 milliseconds (ms) have passed since the entrance sensor 21 detected the leading end of the sheet, or after X2 millimeters (mm) have been conveyed since the entrance sensor 21 detected the leading end of the sheet. In this case, a stop position of the sheet P varies depending on the behavior of the sheet P in the conveying path from the entrance sensor 21 to the pressing roller 14, the reason of which is described as follows.

Figure 12A:
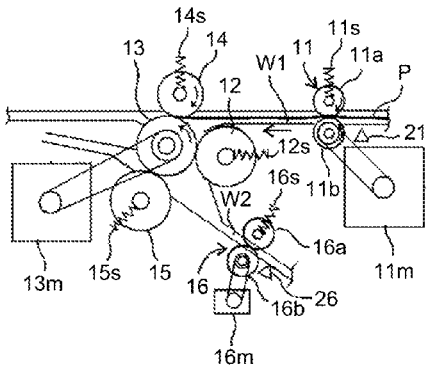
FIGS. 12A and 12B are explanatory diagrams illustrating a case in which a sheet behaves straight after the leading end of a sheet is detected by an entrance sensor until it reaches a pressing roller.
Figure 12B:
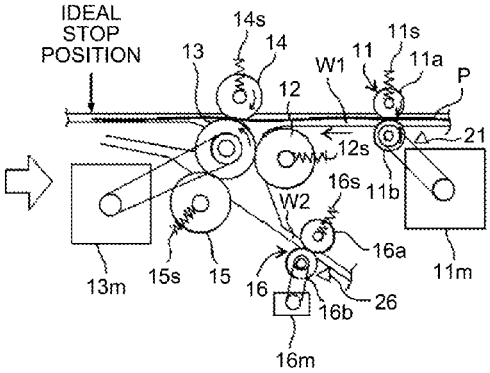
Figure 13A:
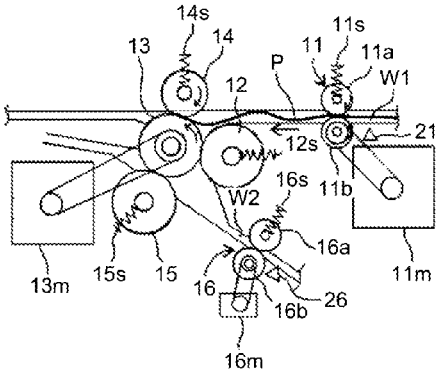
FIGS. 13A and 13B are explanatory diagrams illustrating a case in which a sheet behaves windingly after the leading end of a sheet is detected by the entrance sensor until it reaches the pressing roller.
Figure 13B:
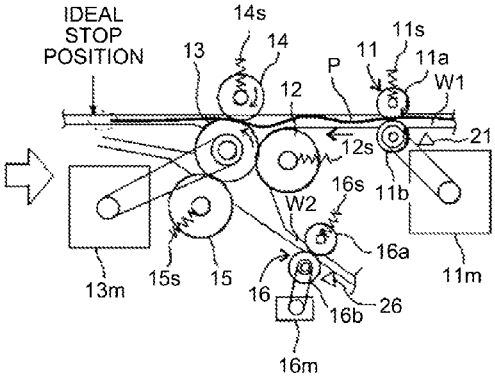

That is, for example, depending on the stiffness of the sheet P, a curl on the sheet P, and/or the like, as the behavior of the sheet P in the conveying path from the pair of entrance rollers 11 to the pressing roller 14, the sheet P may lie straight such as a case illustrated in FIG. 12A, or may be curved such as a case illustrated in FIG. 13A. When the sheet P is stopped after X1 ms have passed, or after X2 mm have been conveyed since the entrance sensor 21 detected the leading end of the sheet, the stop position of the sheet P varies as illustrated in FIGS. 12B and 13B because of such differences in the behavior of the sheet P.

Further, it is difficult to precisely manage the diameters of the pair of entrance rollers 11 and the pressing roller 14, and thus mechanical dimensional errors are inevitable. With a difference between the actual diameters of the pair of entrance rollers 11 and the pressing roller 14, and the ideal diameters thereof, one cycle of the rollers conveys the sheet P by larger than or smaller than an ideal conveyance amount in most cases. When the pair of entrance rollers 11 and the pressing roller 14 conveys the sheet P for a longer distance, more dimensional errors occur that can affect the conveyance amount of the sheet P. Consequently, the errors affect the protrusion amount of the sheet P, thereby changing the folding position of the sheet P. The same is true for a case in which a sheet detection sensor is disposed between the pair of entrance rollers 11 and the pressing roller 14 in the through conveying path W1.

According to the first configuration example, the sheet detection sensor 22 is disposed in the through conveying path W1 downstream of the pressing roller 14 in the sheet conveying direction to detect the leading end of the sheet P. A detection timing of the leading end of the sheet by the sheet detection sensor 22 is used as a trigger to stop the sheet P. This can improve the accuracy of a stop position of the sheet P despite the different behaviors of the sheet P between the pair of entrance rollers 11 and the pressing roller 14.

In other words, after the sheet P is nipped between the pressing roller 14 and the first forward reverse rotation roller 13, the leading end of the sheet is detected by the sheet detection sensor 22 to determine the distance from the detected position to a position at which the sheet P is stopped. Even when the behavior of the sheet P between the pair of entrance rollers 11 and the pressing roller 14 varies as illustrated in FIGS. 12A and 13A, the behavior of the sheet P between the pair of entrance rollers 11 and the pressing roller 14 does not affect the stop position of the leading end of the sheet.

The sheet detection sensor 22 detects the leading end of the sheet very close to a desired stop position of the leading end of the sheet. The behavior of the sheet P can thus have a smaller influence on the stop position in a case in which the leading end of the sheet is detected by the sheet detection sensor 22 than in a case in which the leading end of the sheet is detected by a sheet detection sensor disposed upstream of the pair of entrance rollers 11 in the sheet conveying direction. This can reduce variations of the stop position of the leading end of the sheet that are attributable to the behavior of the sheet P from a timing at which the sheet detection sensor 22 detects the leading end of the sheet to a timing at which the sheet P is stopped, thereby reducing the variations of the protrusion amount. Consequently, the variations of the protrusion amount can be reduced, thereby improving the accuracy of the folding position on the sheet P in the sheet conveying direction.

Second Configuration Example

Figure 14:
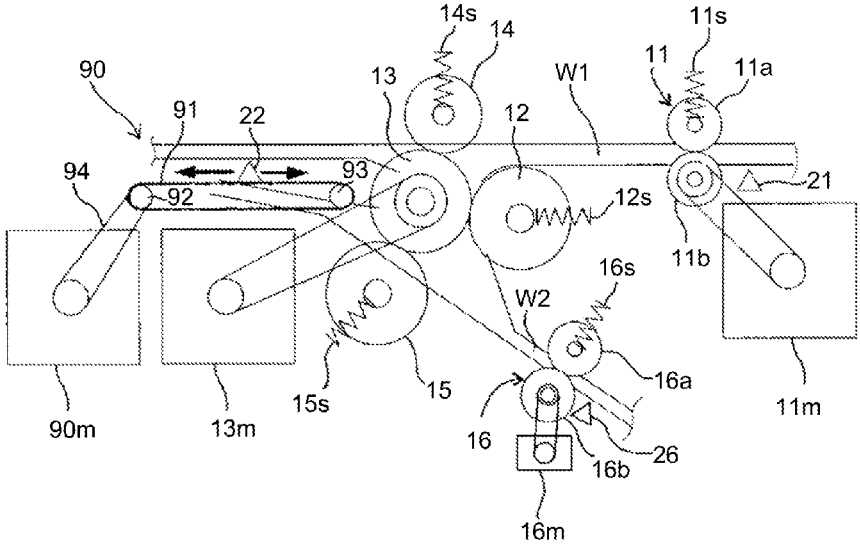
FIG. 14 is a schematic diagram illustrating main units of a folding processing apparatus according to a second configuration example.

FIG. 14 is a schematic diagram illustrating main units of a folding processing apparatus 1 according to a second configuration example.

The folding processing apparatus 1 according to the second configuration example includes a sensor moving device 90 that moves the sheet detection sensor 22 along the through conveying path W1 in the sheet conveying direction as illustrated in FIG. 14. The sensor moving device 90 includes a holding belt 91, a driving roller 92, a driven roller 93, a timing belt 94, and a driving motor 90*m*. The holding belt 91 is rotatably looped over the driving roller 92 and the driven roller 93, and holds the sheet detection sensor 22 on the outer surface thereof. The driving motor 90*m* applies rotational driving force to the driving roller 92 through the timing belt 94 so that the driving roller 92 rotates. The holding belt 91 thus rotates in conjunction with the rotation of the driving roller 92. In this manner, rotation of the holding belt 91 can move the sheet detection sensor 22 along the sheet conveying direction in the through conveying path W1.

When the driving motor 90*m* switches directions between forward rotation and reverse rotation, the rotation of the driving roller 92 is switched between clockwise and counterclockwise in FIG. 14. In conjunction with this, the timing belt 94 rotates clockwise or counterclockwise in FIG. 14, thereby changing a moving direction of the sheet detection sensor 22.

According to the second configuration example, the sheet detection sensor 22 is moved along the sheet conveying direction in the through conveying path W1 by the sensor moving device 90 depending on the size of the sheet or a set value of a folding position on the sheet P. The sheet detection sensor 22 is positioned immediately before a stop position of the leading end of the sheet so that it can detect the leading end of the sheet in that position.

Even when there is a difference between the diameters of the pair of entrance rollers 11 and the pressing roller 14 and the ideal diameters thereof, the influence due to the difference on a conveyance amount of the sheet P can be kept as small as possible, and the accuracy of the stop position of the sheet P can be improved.

The sheet detection sensor 22 needs to be positioned a distance away from the stop position of the leading end of the sheet upstream in the through conveying path W1 in the sheet conveying direction. The distance is equal to or larger than a distance needed for a through-up of the pressing roller 14. Assuming that t (seconds) denotes a through-up time of the first forward reverse rotation motor 13*m* that causes the pressing roller 14 to rotate through the first forward reverse rotation roller 13, and V (millimeters per second [mm/s]) denotes a sheet conveying velocity of the pressing roller 14, the value of the needed distance is equal to or more than V×t millimeters (mm). The sheet detection sensor 22 needs to be set in a position a distance equal to or more than V×t mm away from the stop position of the leading end of the sheet upstream in the through conveying path W1 in the sheet conveying direction. If there is an adjustment value obtained by experiments, it also needs to be considered for setting the distance.

When the adjustment value is not considered for convenience, the position of the sheet detection sensor 22 in the through conveying path W1 may be determined as follows. Assume that, for example, the through-up time of the first forward reverse rotation motor 13*m* that causes the pressing roller 14 to rotate through the first forward reverse rotation roller 13 is 20 ms, and the conveying velocity of the pressing roller 14 is 500 mm/s. In this case, when receiving a stop signal, the first forward reverse rotation motor 13*m* conveys the sheet P by 10 mm before stopping. Accordingly, the sheet detection sensor 22 may be moved to a position at least 10 mm away from the stop position of the leading end of the sheet upstream in the sheet conveying direction.

Third Configuration Example

Figure 15:
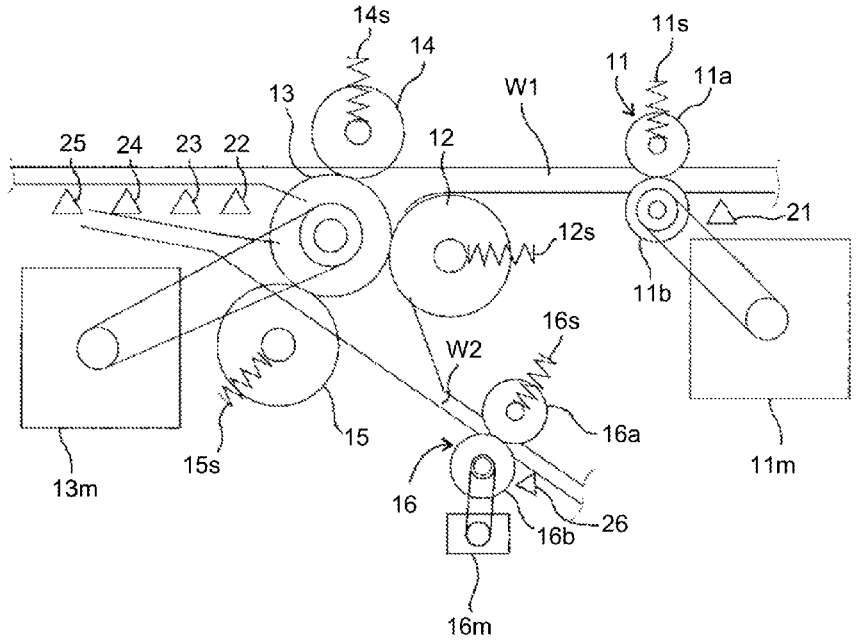
FIG. 15 is a schematic diagram illustrating main units of a folding processing apparatus according to a third configuration example.

FIG. 15 is a schematic diagram illustrating main units of a folding processing apparatus 1 according to a third configuration example.

The folding processing apparatus 1 according to the third configuration example includes four sheet detection sensors 22, 23, 24, and 25 that are sequentially disposed along the sheet conveying direction in the through conveying path W1. The sheet detection sensors used for detecting the leading end of a sheet are thus selectively changed depending on a folding length or the size of the sheet.

The folding processing apparatus 1 of the third configuration example differs from that of the second configuration example in that it cannot move a sheet detection sensor to a desired position by using the sensor moving device 90. Because the sensor moving device 90 is not provided, the folding processing apparatus 1 of the third configuration example has advantages such as reduction in costs and a simple layout.

The description above is given for illustrative purposes only and the present embodiment provides particular advantageous effects for each of the aspects below.

Aspect A

Aspect A provides a sheet folding apparatus such as the folding processing apparatus 1 that includes a first sheet conveying unit such as the pair of entrance rollers 11 that holds a part of a sheet such as the sheet P to apply conveying force to the sheet; a second sheet conveying unit, such as the first forward reverse rotation roller 13 and the pressing roller 14, that is disposed downstream of the first sheet conveying unit in a sheet conveying direction, and holds another part of the sheet to apply conveying force to the sheet; and a folded part forming unit, such as the first forward reverse rotation roller 13 and the first folding roller 12, that forms a folded part on the sheet by nipping a curved portion formed on a part of the sheet between the first and the second sheet conveying units by holding a part of the sheet by the first sheet conveying unit and by applying conveying force to the sheet to reverse the sheet upstream in the sheet conveying direction by the second sheet conveying unit. The sheet folding apparatus includes a sheet leading end detection sensor such as the sheet detection sensor 22 that detects the leading end of the sheet and is disposed downstream of the second sheet conveying unit in the sheet conveying direction, or at almost the same position as the second sheet conveying unit. The sheet is conveyed on the basis of a detection timing of the sheet leading end detection unit such that the leading end of the sheet protrudes by a predetermined protrusion amount from the second sheet conveying unit immediately before applying conveying force to the sheet to reverse the sheet upstream. This can reduce variations of the position of a folded part formed on the sheet in the sheet conveying direction as described in the embodiment above.

Aspect B

According to aspect B, in aspect A, a position of the sheet leading end detection unit in the sheet conveying direction is changed depending on a size of the sheet. According to this, as described in the embodiment above, the influence on a conveyance amount of the sheet due to a difference between the diameter of the rollers and the ideal diameter thereof can be kept as small as possible, and the accuracy of the stop position of the sheet can be improved.

Aspect C

According to aspect C, in aspect A, a position of the sheet leading end detection unit in the sheet conveying direction is changed depending on a set value of a folding position on the sheet. According to this, as described in the embodiment above, the influence on a conveyance amount of the sheet due to a difference between the diameter of the rollers and the ideal diameter thereof can be kept as small as possible, and the accuracy of the stop position of the sheet can be improved.

Aspect D

According to aspect D, in aspect A, a sheet conveyance amount from a time at which the sheet leading end detection unit detects the leading end of the sheet to a time at which the sheet stops is adjusted in accordance with sheet information. According to this, as described in the embodiment above, the protrusion amount of the sheet can be set as appropriate.

Aspect E

According to aspect E, in aspect D, the sheet information is at least either one of a thickness and a type of the sheet. According to this, as described in the embodiment above, a sheet protrusion amount suitable for the thickness and the type of the sheet can be set as appropriate.

Aspect F

Aspect F provides an image forming apparatus that includes an image forming unit, such as the image forming unit 110, that forms an image on a sheet, and a sheet folding unit that is provided in an apparatus body of the image forming apparatus and performs folding processing on the sheet. As the sheet folding apparatus, the sheet folding unit according to any one of aspects A to E is used. According to this, as described in the embodiment above, this can reduce variations of a sheet folding position on the sheet on which an image is formed.

Aspect G

Aspect G provides an image forming system that includes an image forming apparatus that forms an image on a sheet, and a sheet folding apparatus that is provided separately from the image forming apparatus and that performs folding processing on a sheet on which an image is formed. As the sheet folding apparatus, the sheet folding unit according to any one of aspects A to E is used. According to this, as described in the embodiment above, this can reduce variations of a sheet folding position on the sheet on which an image is formed.

According to the embodiment, because the sheet leading end detection unit is disposed downstream of the second sheet conveying unit in the sheet conveying direction, or at almost the same position as the second sheet conveying unit, the sheet leading end detection unit detects the leading end of the sheet after the first and the second sheet conveying units hold the sheet. The sheet folding apparatus stops conveying the sheet on the basis of the timing at which the sheet leading end detection unit detects the leading end of the sheet such that the leading end of the sheet protrudes from the second sheet conveying unit by a predetermined protrusion amount. Thereby, if the behavior of the sheet between the first and the second sheet conveying units varies, that does not affect a stop position of the leading end of the sheet. Variations of the protrusion amount that is attributable to the variations of the behavior of the sheet between the first and the second sheet conveying units can be reduced, thereby improving the accuracy of the position of a folded part formed on the sheet.

The embodiment provides an advantageous effect that variations of the position of a folded part formed on a sheet in a sheet conveying direction can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet folding apparatus comprising:

a first sheet conveying unit configured to convey a sheet in a forward direction;

a second sheet conveying unit downstream of the first sheet conveying unit in a sheet conveying direction, the second sheet conveying unit configured to convey the sheet in the forward direction or a reverse direction;

a first folded part forming unit configured to form a first folded part on the sheet by nipping a deflected portion formed on a part of the sheet between the first sheet conveying unit and the second sheet conveying unit, the deflected portion being formed by conveying the sheet in the reverse direction by the second sheet conveying unit while holding another part of the sheet by the first sheet conveying unit, the first folded part forming unit being downstream of the first sheet conveying unit, the first folded part forming unit including a first roller and a second roller of the plurality of rollers;

a first sheet leading end detection unit configured to detect a leading end of the sheet, the first sheet leading end detection unit being downstream of the second sheet conveying unit in the sheet conveying direction or at almost a same position as the second sheet conveying unit;

a third sheet conveying unit; and a second folded part forming unit configured to form a second folded part on the sheet by nipping another deflected portion between the first folded part forming unit and the third sheet conveying unit, the another deflected portion being formed by conveying the sheet in the reverse direction by the third sheet conveying unit while conveying the folded sheet by the first folded part forming unit, the second sheet conveying unit is configured to convey the sheet in the reverse direction after conveying the sheet in the forward direction by a desired amount and after the leading end of the sheet is detected by the first sheet leading end detection unit, at least a portion of the second sheet conveying unit is part of the first folded part forming unit, and the second sheet conveying unit and the second folded part forming unit include the second roller.

2. The sheet folding apparatus according to claim 1, wherein a position of the first sheet leading end detection unit in the sheet conveying direction is changed according to a size of the sheet.

3. The sheet folding apparatus according to claim 1, wherein a position of the first sheet leading end detection unit in the sheet conveying direction is changed according to a set value of a sheet folded position.

4. The sheet folding apparatus according to claim 1, wherein a sheet conveyance amount conveyed from a time at which the first sheet leading end detection unit detects the leading end of the sheet to a time at which the sheet is stopped is adjusted in accordance with sheet information.

5. The sheet folding apparatus according to claim 4, wherein the sheet information is at least either one of thickness of a sheet or a type of a sheet.

6. The sheet folding apparatus of claim 1, wherein the first sheet conveying unit includes a pair of rollers.

7. The sheet folding apparatus of claim 1, further comprising:

a second sheet leading end detection unit, wherein the second and third sheet conveying units are configured to convey the sheet in the reverse direction after conveying the sheet in the forward direction by the desired amount and after the leading end of the sheet is detected by the first and second sheet leading end detection units.

8. The sheet folding apparatus of claim 1, wherein the second roller is a reversible roller.

9. An image forming apparatus comprising:

an image forming unit configured to form an image on a sheet; and a sheet folding unit above the image forming unit and configured to perform folding processing on the sheet, wherein the sheet folding unit includes, a first sheet conveying unit configured to convey the sheet in a forward direction;

a second sheet conveying unit downstream of the first sheet conveying unit in a sheet conveying direction, the second sheet conveying unit configured to convey the sheet in the forward direction or a reverse direction;

a first folded part forming unit configured to form a first folded part on the sheet by nipping a deflected portion formed on a part of the sheet between the first sheet conveying unit and the second sheet conveying unit, the deflected portion being formed by conveying the sheet in the reverse direction by the second sheet conveying unit while holding another part of the sheet by the first sheet conveying unit, the first folded part forming unit being downstream of the first sheet conveying unit, the first folded part forming unit including a first roller and a second roller of the plurality of rollers;

a first sheet leading end detection unit configured to detect a leading end of the sheet, the first sheet leading end detection unit being downstream of the second sheet conveying unit in the sheet conveying direction or at almost a same position as the second sheet conveying unit;

a third sheet conveying unit; and a second folded part forming unit configured to form a second folded part on the sheet by nipping another deflected portion between the first folded part forming unit and the third sheet conveying unit, the another deflected portion being formed by conveying the sheet in the reverse direction by the third sheet conveying unit while conveying the folded sheet by the first folded part forming unit, the second sheet conveying unit is configured to convey the sheet in the reverse direction after conveying the sheet in the forward direction by a desired amount and after the leading end of the sheet is detected by the first sheet leading end detection unit, at least a portion of the second sheet conveying unit is part of the first folded part forming unit, and the second sheet conveying unit and the second folded part forming unit include the second roller.

10. The image forming apparatus of claim 9, wherein the first sheet conveying unit includes a pair of rollers.

11. An image forming system comprising:

an image forming apparatus configured to form an image on a sheet; and a sheet folding apparatus separate from the image forming apparatus, the sheet folding apparatus configured to perform folding processing on the sheet on which the image is formed by the image forming apparatus, wherein the sheet folding apparatus includes, a first sheet conveying unit configured to convey the sheet in a forward direction;

a second sheet conveying unit that is disposed downstream of the first sheet conveying unit in a sheet conveying direction, the second sheet conveying unit configured to convey the sheet in the forward direction or a reverse direction;

a first folded part forming unit that forms a first folded part on the sheet by nipping a deflected portion formed on a part of the sheet between the first sheet conveying unit and the second sheet conveying unit, the deflected portion being formed by conveying the sheet in the reverse direction by the second sheet conveying unit while holding another part of the sheet by the first sheet conveying unit, the first folded part forming unit being downstream of the first sheet conveying unit, the first folded part forming unit including a first roller and a second roller of the plurality of rollers;

a first sheet leading end detection unit configured to detect a leading end of the sheet, the first sheet leading end detection unit being downstream of the second sheet conveying unit in the sheet conveying direction or at almost a same position as the second sheet conveying unit;

a third sheet conveying unit; and a second folded part forming unit configured to form a second folded part on the sheet by nipping another deflected portion between the first folded part forming unit and the third sheet conveying unit, the another deflected portion being formed by conveying the sheet in the reverse direction by the third sheet conveying unit while conveying the folded sheet by the first folded part forming unit, the second sheet conveying unit is configured to convey the sheet in the reverse direction after conveying the sheet in the forward direction by a desired amount and after the leading end of the sheet is detected by the first sheet leading end detection unit, at least a portion of the second sheet conveying unit is part of the first folded part forming unit, and the second sheet conveying unit and the second folded part forming unit include the second roller.

12. The image forming system of claim 11, wherein the first sheet conveying unit includes a pair of rollers.

* * * * *